US010108139B2

(12) United States Patent
Kim et al.

(10) Patent No.: US 10,108,139 B2
(45) Date of Patent: Oct. 23, 2018

(54) MOVEABLE MEMBER TO MOVE A PRESSURE ROLLER IN A DIRECTION AWAY FROM A FEEDING ROLLER ACCORDING TO AN OPENING OPERATION OF A DOOR

(71) Applicant: S-Printing Solution Co., Ltd., Suwon-si (KR)

(72) Inventors: Yong-jae Kim, Anyang-si (KR); Hyun-woo Kim, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/673,771

(22) Filed: Aug. 10, 2017

(65) Prior Publication Data

US 2018/0143582 A1 May 24, 2018

(30) Foreign Application Priority Data

Nov. 22, 2016 (KR) ..... 10-2016-0155520

(51) Int. Cl.
*G03G 21/16* (2006.01)

(52) U.S. Cl.
CPC ..... *G03G 21/1633* (2013.01); *G03G 21/1638* (2013.01); *G03G 2221/169* (2013.01)

(58) Field of Classification Search
CPC ..... G03G 15/2035; G03G 15/2071; G03G 21/1633; G03G 21/1638; G03G 2221/1672; G03G 2221/1675; G03G 2221/169
See application file for complete search history.

(56) References Cited

U.S. PATENT DOCUMENTS

| | | | | |
|---|---|---|---|---|
| 5,652,942 | A | 7/1997 | Iseki et al. | |
| 6,975,413 | B1 | 12/2005 | Sasaoka | |
| 8,705,989 | B2 | 4/2014 | Kawamura et al. | |
| 9,541,892 | B2 | 1/2017 | Hashimoto | |
| 9,694,999 | B2 | 7/2017 | Lee | |
| 2006/0216060 | A1* | 9/2006 | Kuwata | G03G 15/234 399/110 |
| 2008/0310895 | A1* | 12/2008 | Masuda | G03G 15/2064 399/331 |
| 2009/0148204 | A1* | 6/2009 | Yoshinaga | G03G 15/2035 399/328 |
| 2010/0021186 | A1 | 1/2010 | Okano | |
| 2012/0082478 | A1* | 4/2012 | Wang | G03G 21/1633 399/110 |

FOREIGN PATENT DOCUMENTS

| | | |
|---|---|---|
| EP | 0865928 | 9/1998 |
| JP | 5-58486 | 3/1993 |

(Continued)

*Primary Examiner* — Sophia S Chen
(74) *Attorney, Agent, or Firm* — Staas & Halsey LLP

(57) ABSTRACT

An image forming apparatus includes a main body; a door configured to be connected to the main body by a hinge; a feeding part configured to include a feeding roller for feeding a paper and a pressure roller pressurized to the feeding roller by elastic force of an elastic member to form a nip together with the feeding roller; and a movable member configured to reduce the elastic force applied to the pressure roller so that the pressure roller is moved in a nip releasing direction according to an opening operation of the door.

17 Claims, 11 Drawing Sheets

(56) References Cited

FOREIGN PATENT DOCUMENTS

| | | |
|---|---|---|
| JP | 5-254691 | 10/1993 |
| JP | 5-319617 | 12/1993 |
| JP | 6-1492 | 1/1994 |
| JP | 8-6341 | 1/1996 |
| JP | 8-151165 | 6/1996 |
| JP | 8-259079 | 10/1996 |
| JP | 8-286445 | 11/1996 |
| JP | 9-197736 | 7/1997 |
| JP | 10-265089 | 10/1998 |
| JP | 11-343046 | 12/1999 |
| JP | 2000-335776 | 12/2000 |
| JP | 2001-151365 | 6/2001 |
| JP | 2002-68571 | 3/2002 |
| JP | 2002-154679 | 5/2002 |
| JP | 2002-179343 | 6/2002 |
| JP | 2003-155145 | 5/2003 |
| JP | 2004-252013 | 9/2004 |
| JP | 2005-215182 | 8/2005 |
| JP | 2006-111382 | 4/2006 |
| JP | 2008-145660 | 6/2008 |
| JP | 2008-164780 | 7/2008 |
| JP | 2008-164781 | 7/2008 |
| JP | 2010-15064 | 1/2010 |
| JP | 2010-32722 | 2/2010 |
| JP | 2010-217810 | 9/2010 |
| JP | 2011-32023 | 2/2011 |
| JP | 2011-107253 | 6/2011 |
| JP | 2011-137900 | 7/2011 |
| JP | 2011-203528 | 10/2011 |
| JP | 2011-217157 | 10/2011 |
| JP | 2013-184754 | 9/2013 |
| JP | 2013-230890 | 11/2013 |
| JP | 2014-191134 | 10/2014 |
| JP | 2015-83506 | 4/2015 |
| JP | 2016-145859 | 8/2016 |
| KR | 10-2015-0137893 | 12/2015 |

* cited by examiner

MOVEABLE MEMBER TO MOVE A PRESSURE ROLLER IN A DIRECTION AWAY FROM A FEEDING ROLLER ACCORDING TO AN OPENING OPERATION OF A DOOR

CROSS-REFERENCE TO RELATED APPLICATIONS

This application claims priority from Korean Patent Application No. 10-2016-0155520, filed on Nov. 22, 2016, in the Korean Intellectual Property Office, the disclosure of which is incorporated herein by reference in its entirety.

BACKGROUND OF THE INVENTION

Field of the Invention

Apparatuses consistent with the present disclosure relate to an image forming apparatus, and more particularly, to an image forming apparatus capable of selectively releasing a nip of a feeding roller and a pressure roller.

Description of the Related Art

In general, an image forming apparatus, which is an apparatus for forming an image on a print medium (hereinafter, referred to as 'paper'), corresponds to a printer, a copy machine, a facsimile, and a multi-function printer implemented by incorporating functions of those above-mentioned.

Such a conventional image forming apparatus has a door provided to one side of a main body, and a plurality of developing units that each develop an electrostatic latent image to a visible image through a developer for each of colors, an exposure apparatus that scans light to photoreceptors of the plurality of developing units and forms the electrostatic latent image on the photoreceptor of each developing unit, a transfer apparatus that transfers the visible image developed on the photoreceptor through the developer to a paper, and a fusing apparatus that fuses the developer on the paper, which are installed inside the main body.

When the paper is transported from a cassette to the developing unit, a transport poor phenomenon may occur depending on a state of the paper. Such a transport poor phenomenon is referred to as a jam. In particular, when the state of the paper is poor, such as a size of the paper being not uniform or the paper being wrinkled, the paper is stuck in a feeding part, which results in the jam. In addition, when multiple sheets of papers are simultaneously transported to the developing unit by the feeding part, the jam may also occur.

The above-mentioned jam was generally caused while the paper is jammed between a feeding roller and a pressure roller of the feeding part, and in order to remove the jammed paper, the door is opened and the paper is removed from a movement path in which the paper moves or the feeding part.

Meanwhile, since the door is connected to the feeding part, when the door is opened to open the movement path of the paper, the movement path of the paper is exposed while the feeding part is drawn from the inside to the outside of the main body together with the door.

However, even though the feeding part is drawn to the outside of the main body, there are many image forming apparatuses in which a nip between the feeding roller and the pressure roller of the feeding part is not released. Even if the nip of the image forming apparatus is released when the door is opened, the nip is not completely released and the paper is in a state in which it is still pressed by the pressure roller. In this case, if the paper is pulled, the paper is torn, and consequently, there is a problem in that a secondary jam occurs.

In addition, since the feeding part is configured to be interworked with the opening and closing of the door and consequently, a weight of the feeding part requires a large amount of force of a user when the door is opened and closed, there was a problem in that use convenience is decreased.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an image forming apparatus capable of preventing a secondary jam and preventing quality degradation such as a paper skew, or the like since a nip between a feeding roller and pressure roller of a feeding part may be accurately controlled by interworking with the opening and closing of a door without being affected by an assembled state or a dimension of the pressure roller.

The present disclosure also provides an image forming apparatus capable of manipulating a door with small force.

According to an aspect of the present disclosure, an image forming apparatus includes a main body; a door connected to the main body by a hinge; a feeding part including a feeding roller configured to feed a paper and a pressure roller configured to press against the feeding roller by application of an elastic force of an elastic member to form a nip together with the feeding roller; and a movable member configured to reduce the elastic force applied to the pressure roller so that the pressure roller is moved in a nip releasing direction away from the feeding roller according to an opening operation of the door.

The movable member may have a first end connected to the door by the hinge and a second end connected to a shaft, and when the door is opened, the shaft may be pulled in the nip releasing direction by the movable member.

The shaft may be slidably movable by a guide member.

The guide member may guide the pressure roller in a direction perpendicular to the nip.

A coupling hole into which the shaft is inserted may be formed in one end of the movable member, and the coupling hole may be configured not to press the shaft to the feeding roller in a state in which the door is closed.

An angle range of a direction in which the pressure roller is spaced apart from the feeding roller may be ±15° on the basis of a normal direction to the nip.

The movable member may include a first portion interfering with one portion of the door to be moved when the door is opened; and a second portion formed to be extended in the first portion and releasing the elastic force applied to the shaft by applying pressure one portion of the elastic member.

The shaft may be slidably movable by a guide member.

The second portion may be formed to be bent at a predetermined angle with respect to the first portion.

The second portion may have an inclined surface formed thereon so that one portion of the elastic member is in contact with the second portion and is slidably movable.

The first portion may have an interference protrusion formed to interfere with the main body and to limit a movement range of the movable member to a predetermined range.

The movable member may include a first portion having a central portion connected to one portion of the main body by the hinge and a first end portion interfering with one portion of the door; and a second portion having a first end portion connected to a second end portion of the first portion by the hinge and the other end portion connected to the shaft.

The portions to which the first and second portions are connected by the hinge may be disposed at a position lower than a position of the shaft.

The elastic member may include a torsion spring having a first end connected to the main body and a second end connected to the shaft.

According to another aspect of the present disclosure, an image forming apparatus includes a door configured to be rotatable; a pick-up module including a feeding roller configured to transfer paper from a cassette; a friction module including a pressure roller configured to apply pressure to the pick-up module, disposed to form a nip with the pick-up module where the pressure is applied, and configured to provide a friction force to a surface of the paper passing through the nip; and a link configured to have a first end connected to the door and a second end connected to the friction module, wherein the link is configured to convert a rotation motion of the door into a linear motion as the door is opened to release the pressure applied to the nip formed by the friction module and the pick-up module.

BRIEF DESCRIPTION OF THE DRAWING FIGURES

The above and/or other aspects of the present disclosure will be more apparent by describing certain exemplary embodiments of the present disclosure with reference to the accompanying drawings, in which.

Figure 7:
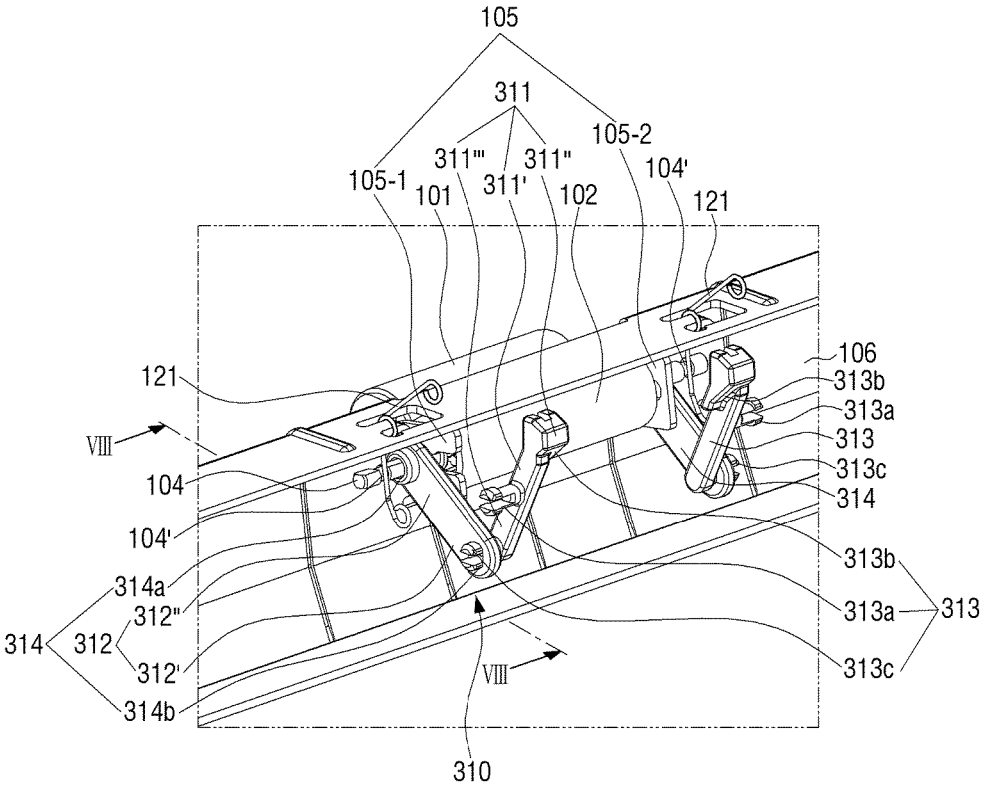
Figure 8A:
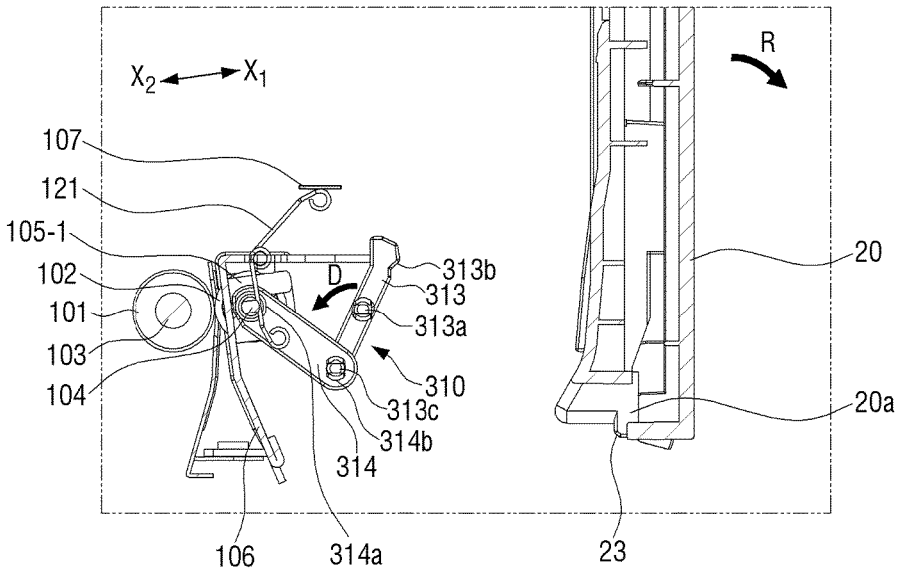
Figure 8B:
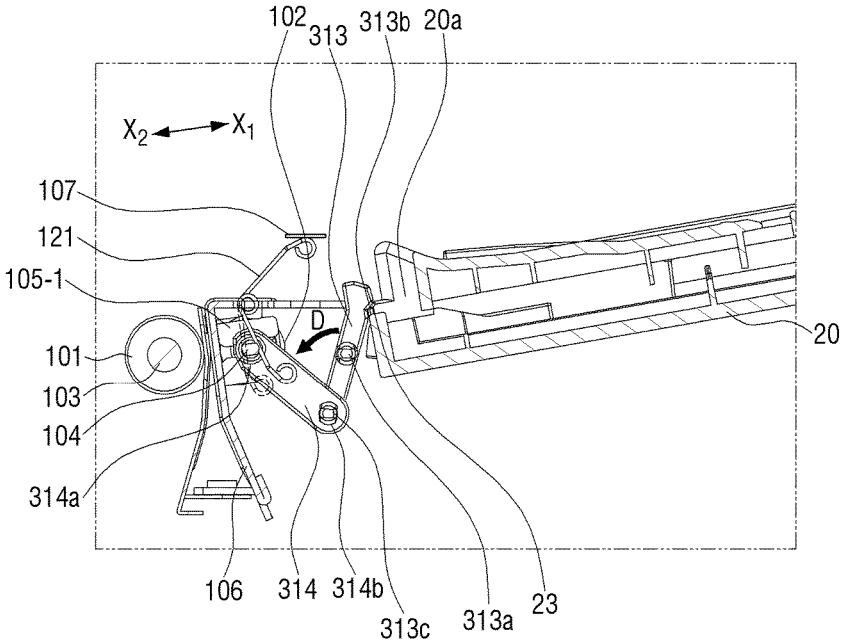

FIG. 7 is a perspective view illustrating a movable member according to still another exemplary embodiment of the present disclosure; and FIGS. 8A and 8B illustrate cross-sections taken along a line of VIII of FIG. 7 and are cross-sectional views illustrating a state in which the movable member according to still another exemplary embodiment of the present disclosure is operated when a door is opened.

DETAILED DESCRIPTION OF THE EXEMPLARY EMBODIMENTS

Hereinafter, diverse exemplary embodiments of the present disclosure will be described in more detail with reference to the accompanying drawings. However, it is to be understood that technologies mentioned in the present disclosure are not limited to specific exemplary embodiments, but include various modifications, equivalents, and/or alternatives according to exemplary embodiments of the present disclosure. Throughout the accompanying drawings, same or similar components will be denoted by same or similar reference numerals.

An image forming apparatus 1 according to an exemplary embodiment of the present disclosure will be described, for example, as a printer, but is not limited thereto, and may be various kinds of image forming apparatuses such as a copy machine, a facsimile, and a multi-function printer implemented by incorporating functions of those above-mentioned.

Hereinafter, the image forming apparatus according to an exemplary embodiment of the present disclosure will be described in detail with reference to FIGS. 1 through 4.

Figure 1:
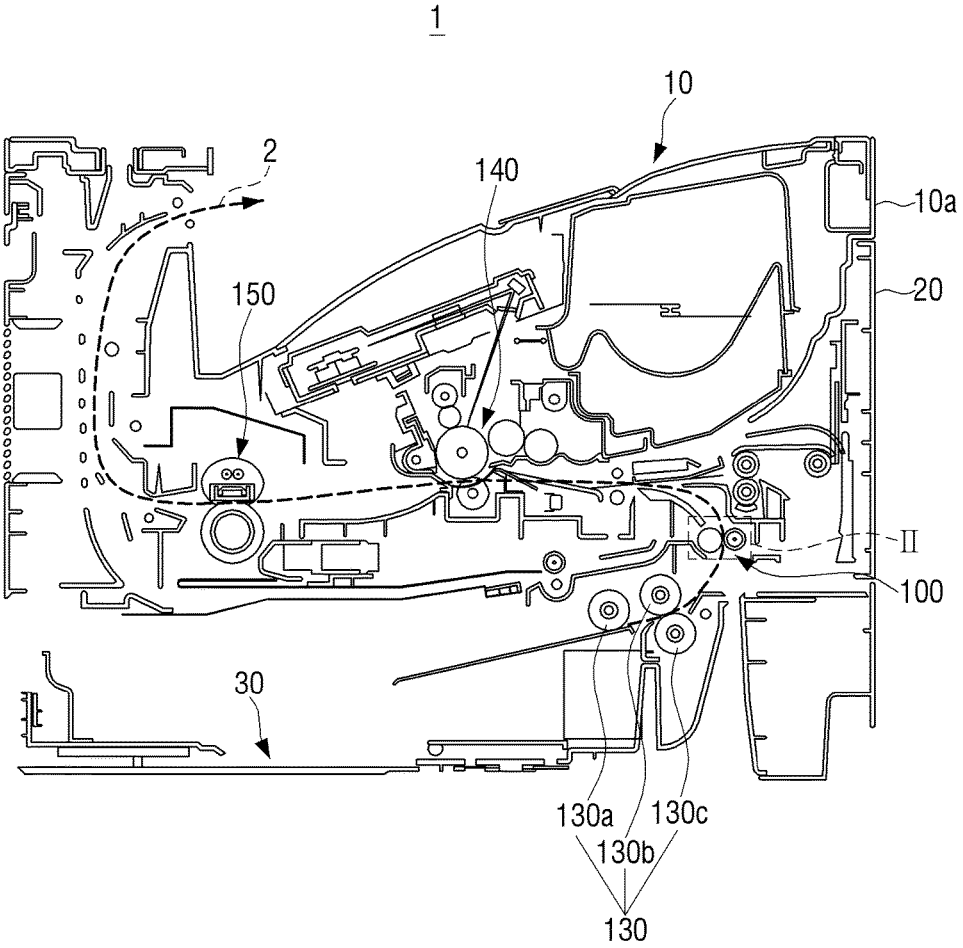
FIG. 1 is a cross-sectional view schematically illustrating a structure of an image forming apparatus.
Figure 2:
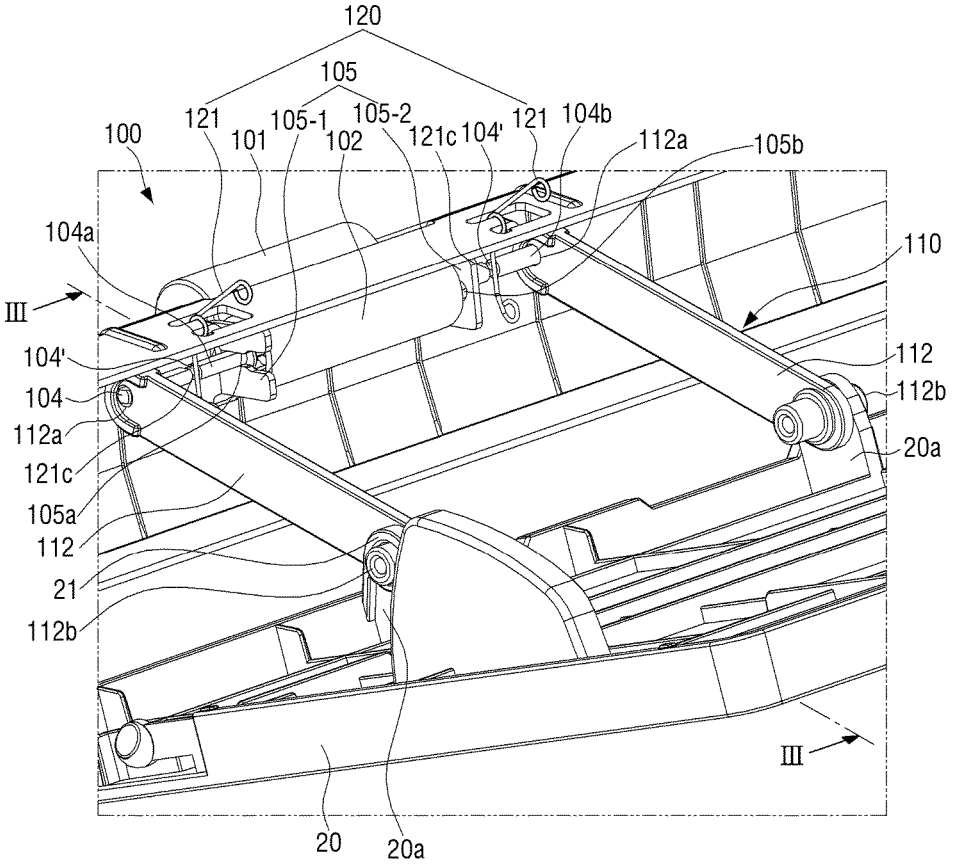
FIG. 2 is an enlarged perspective view of a feeding part of a part II of FIG. 1.
Figure 3A:
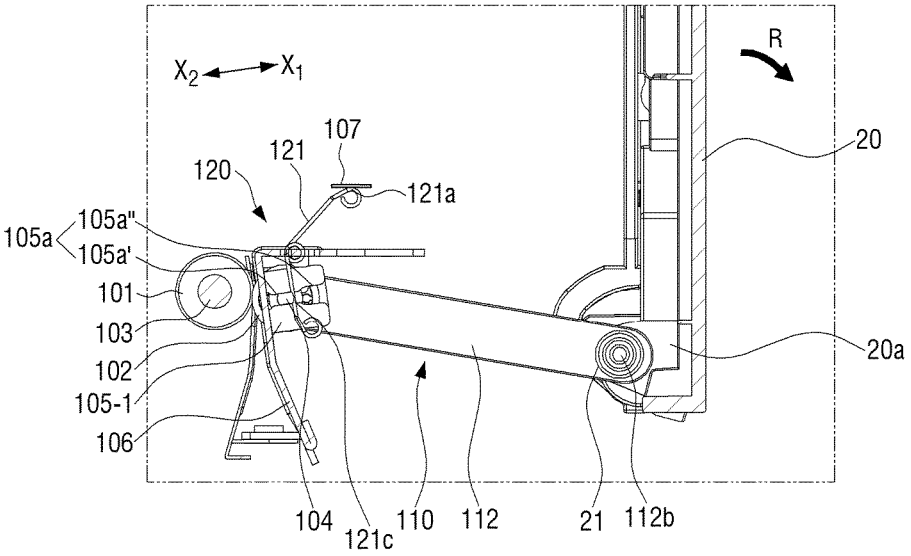
FIGS. 3A and 3B illustrate cross-sections taken along a line of III of FIG. 2 and are cross-sectional views illustrating a state in which a movable member according to an exemplary embodiment of the present disclosure is operated when a door is opened.
Figure 3B:
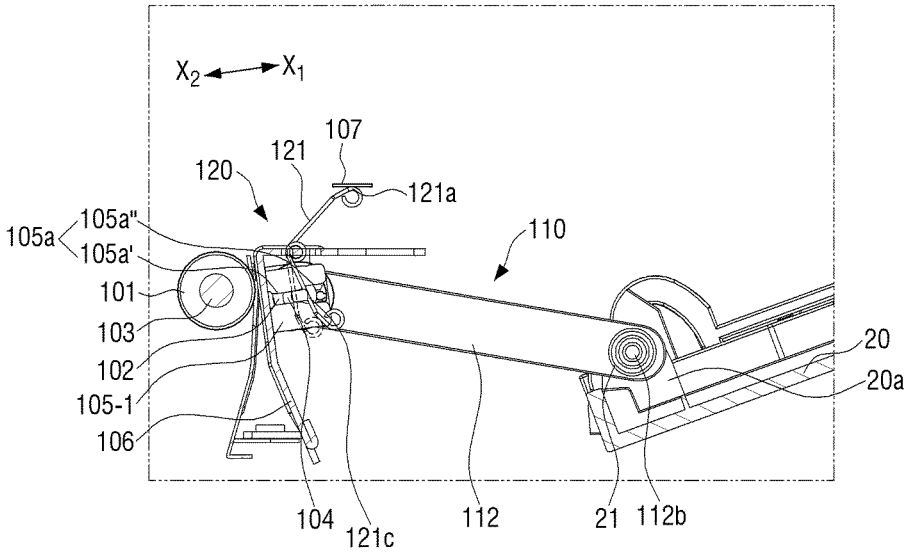
Figure 4:
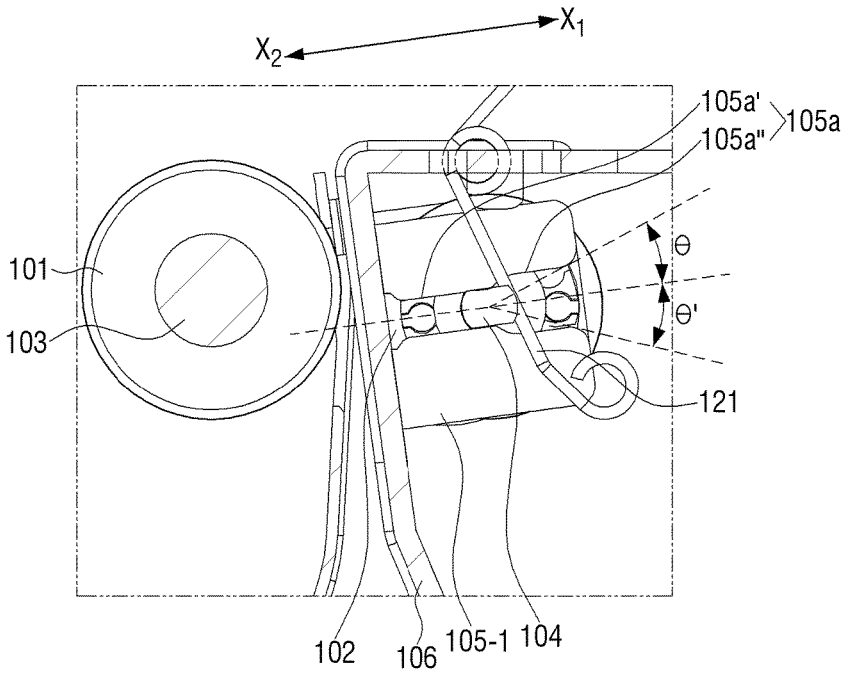
FIG. 4 is a view illustrating an angle range in which a pressure roller is spaced apart from a feeding roller.

FIG. 1 is a cross-sectional view schematically illustrating a structure of an image forming apparatus and FIG. 2 is an enlarged perspective view of a feeding part of a part II of FIG. 1. FIGS. 3A and 3B illustrate cross-sections taken along a line of III of FIG. 2 and are cross-sectional views illustrating a state in which a movable member according to an exemplary embodiment of the present disclosure is operated when a door is opened and FIG. 4 is a view illustrating an angle range in which a pressure roller is spaced apart from the feeding roller.

Referring to FIG. 1, the image forming apparatus 1 has an appearance formed by a main body 10 and a door 20 provided to one side 10*a* of the main body.

The main body 10 includes a photosensitive medium (not shown) on which an electrostatic latent image is formed, a developing unit 140 that forms the electrostatic latent image of the photosensitive medium into a visible image, a transfer unit (not shown) that transfers the visible image to a recoding medium, and a fusing unit 150 for fusing the transferred image on the recording medium.

The door 20 is hingeably connected to one side 10*a* of the main body.

The door 20 exposes a section that passes through a feeding part 100 of a paper transport path 2 inside the main body 10 of the image forming apparatus while being opened.

The main body 10 includes a cassette 30 in which the paper is loaded. In addition, a pick-up roller 130 for transporting the paper to the feeding part 100 is disposed over the cassette 30.

The pick-up roller 130 may include a plurality of pick-up rollers 130*a*, 130*b*, and 130*c*, and is connected to a driving part and is in contact with one surface of the paper loaded in the cassette 30 while being rotated in a predetermined direction.

The plurality of pick-up rollers 130*a*, 130*b*, and 130*c* provide maximum friction force to the paper loaded in the cassette 30 to transport an uppermost paper loaded in the cassette 30 to the feeding part 100.

The paper transported to the feeding part 100 is transported to the developing unit 140 along the paper transport path 2 by pick-up and friction modules.

Referring to FIGS. 2 to 3B, the feeding part 100 includes a feeding roller 101 for transporting the paper to the developing unit 140, a pressure roller 102 for forming a nip together with the feeding roller, an elastic member 120 for pressurizing the pressure roller 102 toward the feeding roller 101, and a movable member 110 for controlling elastic force of the elastic member 120 by interworking the opening and closing operation of the door 20 to move the pressure roller 102.

The feeding roller 101 is rotated in a direction in which the paper is transported to the developing unit 140 by driving force of a driving part (not shown). In this case, the feeding roller 101 is coupled to a first shaft 103 to be rotated together with the first shaft 103.

In addition, the feeding roller 101 transports the paper transported from the cassette 30 using the friction force to the developing unit 140 positioned over the cassette 30.

The first shaft 103 receives power from the driving part that rotates the pick-up roller 130. Accordingly, the rotation of the pick-up roller 130 and the rotation of the feeding roller 101 may be synchronized with each other. The first shaft 103 may also be configured to receive the power from a separate driving part.

The pressure roller 102 is in contact with the feeding roller 101 to form the nip, and is rotatably coupled to a second shaft 104. The second shaft 104 is an idle shaft which does not receive the driving force from the driving part.

The pressure roller 102 provides the friction force to one surface of the paper that passes through the nip to smoothly transport the paper from the feeding part 100 to the developing unit 140.

The pressure roller 102 is not connected to the driving part (not shown), and is rotated in a direction opposite to the rotation direction of the feeding roller 101 at the time of rotating the feeding roller 101 while being pressurized to the feeding roller 101. Accordingly, according to the present exemplary embodiment, it is possible to simply a configuration of the feeding part 100 and to reduce power consumption.

The second shaft 104 has both ends supported by a guide member 105 formed on a feeding part frame 106 forming the feeding part 100.

The guide member 105 is formed to be extended in a direction (a direction directed from $X_2$ to $X_1$ indicated in FIG. 3) releasing the nip of the pressure roller 102 and the feeding roller 101.

The guide member 105 may include a first guide member 105-1 and a second guide member 105-2 which are disposed to be spaced apart from each other by an interval. An opened guide groove 105*a* is formed in the first guide member 105-1. In addition, a closed loop guide groove 105*b* is formed in the second guide member 105-2.

One end 104*a* of the second shaft 104 is coupled to the opened guide groove 105*a* so as to be slidable in a linear direction. In this case, one end 104*a* of the second shaft 104 may be separated from the opened guide groove 105*a*.

The other end 104*b* of the second shaft 104 is coupled to the closed loop guide groove 105*b* so as to be slidable in the linear direction. However, the closed loop guide groove 105*b* is formed in a long hole shape so that the other end 104*b* of the second shaft 104 may not be separated therefrom, unlike the opened guide groove 105*a*.

The second shaft 104 may be sliding-linearly moved in the direction from $X_2$ to $X_1$ along the opened guide groove 105*a* and the closed guide groove 105*b*, so as to release the nip by moving the pressure roller 102 to a direction which is away from the feeding roller 101.

The opened guide groove 105*a* and the closed guide groove 105*b* linearly guide the second shaft 104 and convert a rotation motion of the door 20 into a linear motion of the second shaft 104 when the door 20 is opened.

As such, as the rotation motion of the door 20 is converted into the linear motion of the second shaft 104, the friction force occurs at portions at which the second shaft 104 is in contact with the opened guide groove 105*a* and the closed guide groove 105*b*.

In order to minimize such friction force, the opened guide groove 105*a* is preferably formed so that a width of a second section 105*a*" which is far from the feeding roller 101 is wider than a width of a first section 105*a*' which is close to the feeding roller 101.

Both ends 104*a* and 104*b* of the second shaft 104 are each pressurized by a pair of elastic members 120 as illustrated in FIG. 2 so that the feeding roller 101 and the pressure roller 102 may form the nip.

The elastic member 120 may be configured as a torsion spring 121, but is not limited thereto, and a various kinds of springs capable of elastically supporting the second shaft 104 may be used to pressurize the pressure roller 102 to the feeding roller 101.

However, in order to facilitate the understanding of the present disclosure, hereinafter, the elastic member 120 will be described, for example, as including the torsion spring 121.

As the elastic member 120 elastically supports both ends 104*a* and 104*b* of the second shaft and the pressure roller 102 is pressurized to the feeding roller 101, it is possible to prevent a skew phenomenon which may occur in the paper.

One end 121*a* of the torsion spring is elastically supported by a fixed rib 107 formed inside the main body 10. In addition, one portion 121*c* of the torsion spring is inserted into a separation preventing groove 104' formed in the second shaft 104 to elastically pressurize the second shaft 104 to the feeding roller 101. The separation preventing groove 104' of the second shaft 104 prevents the torsion spring 121 from being moved along a shaft direction of the second shaft 104.

A pair of movable members 110 may be connected to both ends 104*a* and 104*b* of the second shaft.

The movable member 110 may be preferably formed by a single link, but is not limited thereto. However, for convenience of explanation, an example in which the movable member 110 is formed by the single link 112 will be described.

A connection hole 112*a* which is hingeably connected to the second shaft 104 is formed in one end of the single link 112.

A hinge protrusion 112*b* is formed on the other end of the single link 112 and is hingeably connected to a hinge hole 21 formed in one end 20*a* of the door 20.

The hinge hole 21 of the door 20 is preferably set to a position different from a rotation center of the door so that the hinge protrusion 112*b* is pulled in a direction of $X_1$ at the time of opening the door 20. The feeding part 100 according to an exemplary embodiment of the present disclosure may include at least two or more single links 112, and the single links 112 are preferably connected to both ends 104*a* and 104*b* of the second shaft 104, but are not necessarily limited thereto. It is also possible for the single links 112 to be connected to only any one of both ends of the second shaft 104.

An operation in which the movable member 110 according to the present exemplary embodiment is operated by interworking the opening and closing of the door 20 will be described with reference to FIGS. 3A to 4.

FIGS. 3A and 3B illustrate cross-sections taken along a line of III of FIG. 2 and are cross-sectional views illustrating a state in which a movable member 110 according to an exemplary embodiment of the present disclosure is operated when a door 20 is opened and FIG. 4 is a view illustrating an angle range in which a pressure roller 102 is spaced apart from the feeding roller 101.

If the jam occurs while the paper picked-up by the pick-up roller 130 from the cassette 30 is transported along the paper transport path 2, the user opens the door 20 to remove the jammed paper.

If the door 20 rotates in a R direction (see FIG. 3A) about a door shaft (not shown), the single link 112 is moved in a $X_1$ direction as the hinge protrusion 112*b* of the single link 112 connected to the hinge hole 21 of the door is pulled in the $X_1$ direction.

At the same time, the second shaft 104 connected to the connection hole 112*a* is pulled in the $X_1$ direction to release the nip.

As such, if a pair of single links 112 pulls the second shaft 104 in the $X_1$ direction, the torsion spring 121 that elastically supports the second shaft 104 is compressed and deformed.

Therefore, the second shaft 104 pulled by the pair of single links 112 is slide along the guide grooves 105*a* and 105*b* formed in the first and second guide members 105-1 and 105-2, and is moved in a direction ($X_1$ direction) in which the nip of the feeding roller 101 and the pressure roller 102 is released.

In addition, the pressure roller 102 is moved in the $X_1$ direction that releasing the nip together with the second shaft 104, such that the nip between the pressure roller 102 and the feeding roller 101 is released.

That is, the rotation motion in the R direction of the door 20 for opening the door is converted into a linear motion of the second shaft 104 by the movable member 110, and the nip between the pressure roller 102 and the feeding roller 101 is released.

However, in a case in which the second shaft 104 moves an excessively long distance in the $X_1$ direction, the torsion spring 121 may also be permanently deformed. In the case in which the torsion spring 121 is permanently deformed, even if the door 20 is closed, the second shaft 104 is not sufficiently pressurized to the feeding roller 101, and consequently, the nip may not be formed between the pressure roller 102 and the feeding roller 101. Therefore, in order to prevent the permanent change of the torsion spring 121, it is preferable to limit the movement distance of the second shaft 104 within a range in which the paper jammed in the feeding part 100 may be easily removed.

Referring to FIG. 4, an angle range (θ, θ') of a direction in which the pressure roller 102 is spaced apart from the feeding roller 101 is preferably formed within a range of ±15° on the basis of a normal to a surface on which the feeding roller 101 and the pressure roller 102 form the nip.

Such a range is to again form the nip at the same position as a position at which the nip is formed by an initial design of the image forming apparatus, when the door 20 is again closed and the pressure roller 102 is pressurized by the elastic member 120 and forms the nip together with the feeding roller 101.

When the nip between the pressure roller 102 and the feeding roller 101 is released according to the above-mentioned operations, the pressure roller 102 no longer pressures the paper jammed in the feeding part 100.

Accordingly, the paper jammed in the feeding part 100 may be easily removed from the feeding part 100. In addition, upon removing the paper, a secondary jam does not occur.

In a case in which the paper jammed in the feeding part 100 is removed and the door 20 is closed, when the door 20 rotates in a direction opposite to the R direction about a door shaft (not shown), the hinge hole 112*b* formed in the other end of the single link is pushed in a $X_2$ direction.

Thereby, the single link 112 moves in the $X_2$ direction, and the second shaft 104 connected to the connection hole 112*a* moves in the $X_2$ direction forming the nip.

When the door 20 is closed and the single link 112 pushes the second shaft 104 to the feeding roller 101, external force deforming the torsion spring 121 is removed.

Therefore, the torsion spring 121 is returned to an original form by elasticity and further pressurizes the second shaft 104 to the feeding roller 101. In addition, as the second shaft 104 moves in the $X_2$ direction, the pressure roller 102 is pressurized to the feeding roller 101 and the nip is again formed.

Since the torsion spring 121 continuously pressurizes the second shaft 104 to the feeding roller 101, the pressure roller 102 and the feeding roller 101 maintain the nip until the door 20 is again opened.

According to an exemplary embodiment of the present disclosure, the movable member 110 is configured by the pair of single links 112, and the rotation motion of the door 20 is converted into the linear motion of the second shaft 104 by the movable member 110, thereby making it possible to simply a nip releasing structure.

In addition, according to an exemplary embodiment of the present disclosure, it is possible to reduce cost for manufacturing the image forming apparatus, to increase mass production property, to facilitate maintenance, and to minimize a malfunction.

Hereinafter, an image forming apparatus according to another exemplary embodiment of the present disclosure will be described with reference to FIGS. 5 to 6B.

However, since an image forming apparatus according to another exemplary embodiment of the present disclosure is different from the image forming apparatus according to an exemplary embodiment only in the configuration of the movable member, only the configuration of the movable member will be described and a description of the remaining same configuration will be omitted.

Figure 5:
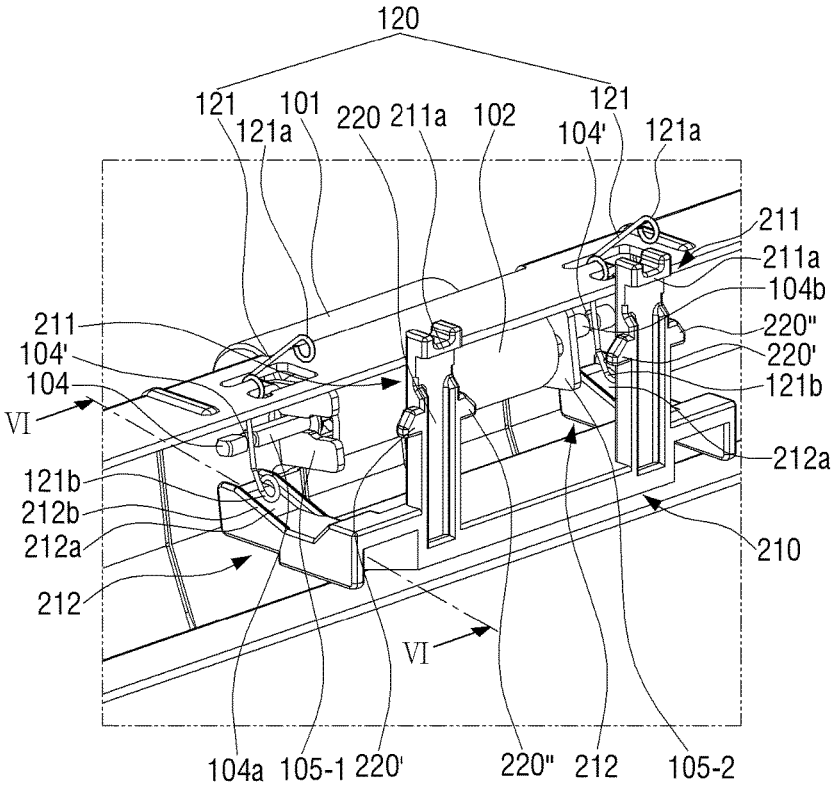
FIG. 5 is a perspective view illustrating a movable member according to another exemplary embodiment of the present disclosure.
Figure 6A:
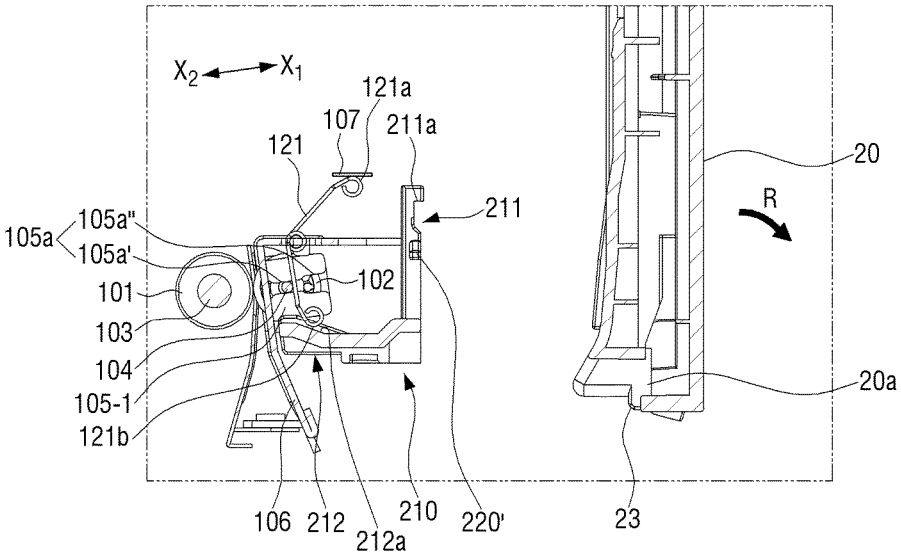
FIGS. 6A and 6B illustrate cross-sections taken along a line of VI of FIG. 5 and are cross-sectional views illustrating a state in which the movable member according to another exemplary embodiment of the present disclosure is operated when a door is opened.
Figure 6B:
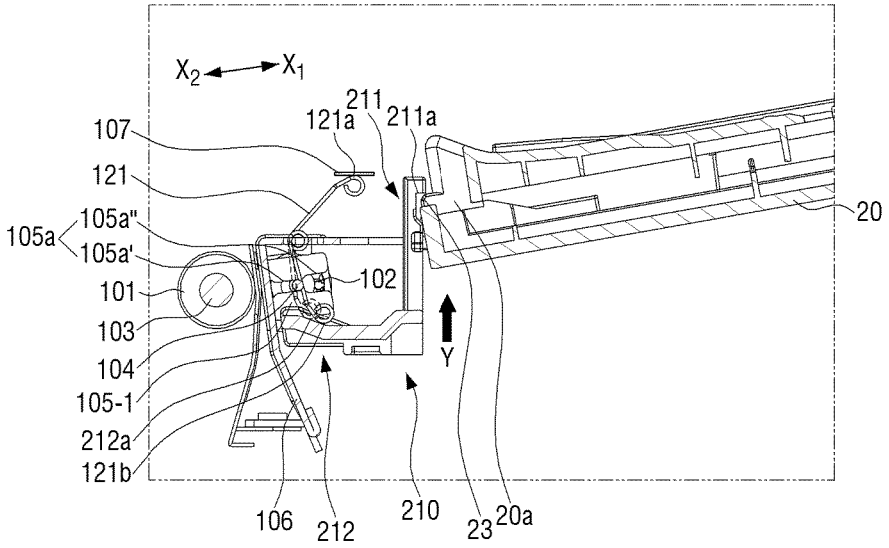

FIG. 5 is a perspective view illustrating a movable member 210 according to another exemplary embodiment of the present disclosure and FIGS. 6A and 6B illustrate cross-sections taken along a line of VI of FIG. 5 and are cross-sectional views illustrating a state in which the movable member 210 according to another exemplary embodiment of the present disclosure is operated when a door 20 is opened.

The movable member 210 according to another exemplary embodiment of the present disclosure includes a first portion 211 that interferes with one end 20*a* of the door and is linearly moved when the door 20 is opened, and a second portion 212 that is formed to be extended from the first portion and is in contact with the elastic member 120.

A contact part 23 which is in contact with the first portion 211 of the movable member 210 while being rotated at the time of opening the door 20 is formed at one end 20*a* of the door 20, and a first bending part 211*a* for being in contact with the contact part 23 of the door is formed at one end of the first portion 211 of the movable member.

The first bending part 211*a* has a cross section which may be formed in a shape of "¬", and is disposed so as to be caught by the contact part 23 of the door while being rotated at the time of opening the door 20.

A shape of the first bending 211*a* preferably has the cross section of the shape of "¬", but the first bending part 211*a* may have any cross-sectional shape as long as the shape allows the first bending part 211*a* to be in contact with the contact part 23 of the door so that the contact part 23 is caught by the first bending part 211*a*.

If the first bending part 211*a* is caught by the contact part 23 of the door, the movable member 210 is moved in a Y direction (see FIG. 6B) according to the opening and closing of the door 20.

In addition, at least one or more interference protrusions 220' and 220" may be formed on an intermediate portion 220 of the first portion 211 of the movable member 210 according to the present exemplary embodiment.

The interference protrusions 220' and 220" are formed to protrude to the left and right of the intermediate portion 220 and are configured to be caught by an internal frame (not shown) of the main body.

At least one interference protrusions 220' and 220" are preferably formed at a position lower than the first bending part 211*a* so that the first portion 211 may move in the Y direction and does not disturb the opening and closing operation of the door 20 at the same time.

As such, a distance that the first portion 211 may be linearly moved in the Y direction and the direction opposite to the Y direction is limited to a predetermined range by the interference protrusions 220' and 220".

According to the movement of the first portion 211, the elastic member 120 which is in contact with the second portion 212 is deformed, and when the first portion 211 moves an excessively long distance, the elastic member 120 may be permanently deformed.

In the case in which the elastic member 120 is permanently deformed, even if the door 20 is closed, the elastic member 120 does not pressurize the second shaft 104 and the pressure roller 102 is not pressurized to the feeding roller 101, and consequently, the nip is not formed between the pressure roller 102 and the feeding roller 101.

Therefore, in order to minimize the spaced distance from the feeding roller 101 in a state in which the pressure roller 102 may not apply friction force or pressure to the paper, it is preferable to form at least one or more interference protrusions 220' and 220" that limit the movement distance of the first portion 211.

The second portion 212 of the movable member 210 according to the present exemplary embodiment is formed to be bent at a predetermined angle with respect to the first portion 211, and is in contact with the elastic member 120 to reduce elastic force so that the elastic member 120 does not pressurize the second shaft 104.

The second portion 212 is preferably formed to be bent at 90° with respect to the first portion 211 to transfer the movement of the first portion 211 in the Y direction to the elastic member 120 to deform the elastic member 120.

However, the angle at which the second portion 212 is formed with respect to the first portion 211 is not limited thereto, and any angle may be sufficient as long as the second portion 212 may transfer the movement of the first portion 211 in the Y direction to the elastic member 120 to deform the elastic member 120.

According to the present exemplary embodiment, an example in which the elastic member 120 is configured as the torsion spring 121 will be described.

The second portion 212 includes an inclined surface 212*a* which is in contact with the other end 121*b* of the torsion spring to allow the other end 121*b* of the torsion spring to be sliding-moved.

The inclined surface 212*a* is preferably downwardly inclined from the $X_2$ direction to the $X_1$ direction as illustrated in FIG. 6.

This is to prevent the torsion spring 121 from being permanently deformed while being moved along the inclined surface 212*a* when the door 20 is opened, and to allow the torsion spring 121 to naturally pressurize the second shaft 104 in the $X_2$ direction when the door 20 is closed.

In addition, in order to prevent the other end 121*b* of the torsion spring from being separated from the inclined surface 212*a* while being sliding-moved on the inclined surface 212*a* of the second portion, a separation preventing wall 212*b* is preferably formed on both sides of the inclined surface 212*a* of the second portion.

An operation in which the movable member 210 according to the present exemplary embodiment is operated by interworking the opening and closing of the door 20 will be described with reference to FIGS. 6A and 6B.

If the jam occurs while the paper picked-up by the pick-up roller 130 from the cassette 30 is transported along the paper transport path 2, the user opens the door 20 to remove the jammed paper.

In the case in which the door 20 is opened, when the door 20 is rotated by a predetermined distance in the R direction (see FIG. 6A), the contact part 23 formed at the one end 20*a* of the door is in contact with the first bending part 211*a* formed in the first portion 211 of the movable member.

The contact part 23 of the door is caught by the first portion 211 of the movable member by the shape of "¬" of the first bending part 211*a*.

The door 20 pushes up the first bending part 211*a* formed in the first portion 211 while being continuously rotated in the R direction.

Thereby, the first portion 211 of the movable member is moved in the Y direction, and the second portion 212 formed to be extended in the first portion is also moved in the Y direction.

As the second portion 212 is moved in the Y direction, the other end 121*b* of the torsion spring is in contact with the inclined surface 212*a* formed in the second portion.

As the second portion 212 is moved in the Y direction, the other end 121*b* of the torsion spring which is in contact with the inclined surface 212*a* is sliding-moved in the $X_1$ direction, and is deformed so that the elastic force pressurizing the second shaft 104 is reduced.

When the elastic force pressurizing the second shaft 104 to the feeding roller 101 is removed, the second shaft 104 is moved in the $X_1$ direction along the opened guide groove 105*a* formed in the guide member 105, and the nip between the pressure roller 102 and the feeding roller 101 is released.

That is, the rotation motion of the door 20 is converted into the linear motion of the second shaft 104 by the movable member 210, and the nip between the pressure roller 102 and the feeding roller 101 is released according to the opening of the door 20.

In the present exemplary embodiment as well, an angle range (θ, θ') of a direction in which the pressure roller 102 is spaced apart from the feeding roller 101 is preferably formed within a range of ±15° from a normal to a tangent surface on which the feeding roller 101 and the pressure roller 102 form the nip.

In addition, in a case in which the second shaft 104 moves an excessively long distance in the $X_1$ direction, since the elastic member 120 may be permanently deformed, it is preferable to minimize the movement distance of the second shaft 104 to the extent that the friction force or the pressure may not be applied to the paper.

According to the present exemplary embodiment, in order to limit the movement distance of the second shaft 104, at least one or more interference protrusions 220' and 220" formed on the first portion of the movable member are configured to be in contact with an internal frame (not shown) of the main body.

In a case in which the nip is released according to the above-mentioned operations, since the pressure roller 102 no longer provides the friction force or the pressure to the paper jammed in the feeding part 100, the user may easily remove the paper jammed in the feeding part 100 from the feeding part 100.

When the user removes the paper jammed in the feeding part 100 and closes the door 20, the door 20 rotates in a direction opposite to the R direction, and the contact part 23 formed at one end 20*a* of the door 20 rotates in an outward direction of the main body.

When the contact part 23 rotates in the outward direction of the main body, the first bending part 211*a* is moved a direction opposite to the Y direction by a predetermined distance in a state in which the first bending part 211*a* is in contact with the contact part 23.

When the first bending part 211*a* descends by a predetermined distance, the interference protrusions 220' and 220" formed on the intermediate portion 220 are caught by an internal frame (not shown) of the main body, and the first bending part 211*a* may no longer linearly move in the direction opposite to the Y direction.

In addition, the contact part 23 of the door is spaced apart from the first bending part 211*a* and is continuously rotated in the outward direction of the main body.

As the first bending part 211*a* descends by the predetermined distance, the first and second portions 211 and 212 of the movable member 210 simultaneously descend, and the external force applied to the other end 121*b* of the torsion spring which was in contact with the inclined surface 212*a* of the second portion is removed.

Thereby, the other end 121*b* of the torsion spring is sliding-moved in the $X_2$ direction along the inclined surface 212*a* by the elastic force.

In a case in which the torsion spring 121 is returned to an original state, the torsion spring 121 pressurizes the second shaft 104 to the feeding roller 101, and the pressure roller 102 forms the nip together with the feeding roller 101.

Since the torsion spring 121 continuously pressurizes the second shaft 104 to the feeding roller 101, the pressure roller 102 and the feeding roller 101 maintain the nip until the door 20 is again opened.

According to the present exemplary embodiment, the movable member 210 converts the rotation motion of the door 20 into the linear motion of the second shaft 104, thereby making it possible to simply a nip releasing structure.

In addition, it is possible to reduce cost for manufacturing the image forming apparatus, to increase mass production property, to facilitate maintenance, and to minimize a malfunction.

Hereinafter, an image forming apparatus according to still another exemplary embodiment of the present disclosure will be described with reference to FIGS. 7 to 8B.

However, since an image forming apparatus according to still another exemplary embodiment of the present disclosure is different from the image forming apparatus according to an exemplary embodiment only in the configuration of the movable member, only the configuration of the movable member will be described and a description of the remaining same configuration will be omitted.

FIG. 7 is a perspective view illustrating a movable member 310 according to still another exemplary embodiment of the present disclosure and FIGS. 8A and 8B illustrate cross-sections taken along a line of VIII of FIG. 7 and are cross-sectional views illustrating a state in which the movable member 310 according to still another exemplary embodiment of the present disclosure is operated when a door is opened.

The movable member 310 according to still another exemplary embodiment of the present disclosure includes a first portion 311 and a second portion 312.

A central portion 311' of the first portion is connected to one portion of the main body 10 by a hinge.

In addition, one end portion 311" of the first portion is configured to be in contact with the contact part 23 formed at the one end 20*a* of the door 20.

In addition, the other end portion 311'" of the first portion is connected to one end portion 312' of the second portion by the hinge.

The other end portion 312" of the second portion is connected to the second shaft 104.

The first and second portions 311 and 312 are configured as first and second links 313 and 314, but are not limited thereto.

However, in the present exemplary embodiment, for increasing the understanding of the present disclosure and for convenience of explanation, an example in which the first and second portions 311 and 312 are each configured as the first and second links 313 and 314 will be described.

A second bending part 313*b* is formed at one end 311" of the first link 313 so that the contact part 23 formed at the one end of the door 20 may be in contact with the first link 313 and push the first link 313.

A cross section of the second bending part 313*b* may be formed in a shape of "¬", and is configured so that the contact 23 of the door 20 is caught by the second bending part 313*b* when the door 20 is opened.

A shape of the second bending 313*b* preferably has the cross section of the shape of "¬", but the second bending part 313*b* may have any cross-sectional shape as long as the shape allows the contact part 23 to be caught by the second bending part 313*b*.

A first hinge protrusion 313*a* which is hingeably connected to one portion (not shown) inside the main body is formed on the central portion 311' of the first link 313.

The first link 313 may rotate in a D direction (see FIG. 8A) with the first hinge protrusion 313*a* as a central axis.

A second hinge protrusion 313*c* is formed at the other end 311'" of the first link 313.

The second hinge protrusion 313*c* is hingeably coupled to a hinge hole 314*b* formed in one end 312' of the second link 314.

In addition, the second hinge protrusion 313*c* of the first link 313 and the hinge hole 314*b* of the second link 314 are preferably connected at a position lower than a position of the second shaft 104.

This is to allow the second shaft 104 to convert a rotation motion of the first link 313 in which the second link 314 is rotated in the D direction into a linear motion along the opened guide groove 105*a*.

A coupling hole 314*a* is formed in the other end 312" of the second link 314 and is hingeably connected to the second shaft 104.

An operation in which the movable member 310 according to the present exemplary embodiment is operated by interworking the opening and closing of the door 20 will be described with reference to FIGS. 8A and 8B.

In the present exemplary embodiment, in order to help the understanding of the operation, an example in which the first and second portions 311 and 312 are configured as the first and second links 313 and 314, and the elastic member 120 is configured as the torsion spring 121 will be described.

If the jam occurs while the paper picked-up by the pick-up roller 130 from the cassette 30 is transported along the paper transport path 2, the user opens the door 20 to remove the jammed paper.

In a case in which the user opens the door 20 by external force, when the door 20 is rotated by a predetermined distance in the R direction, the contact part 23 formed at the one end 20*a* of the door is in contact with the second bending part 313*b* formed in the first link 313 of the movable member 310.

The contact part 23 of the door 20 is caught by the first link 313 of the movable member by the shape of "¬" of the second bending part 313*b*.

When the door 20 is continuously rotated in the R direction, the contact part 23 pushes the second bending part 313*b* formed in the first link 313 to the D direction, and the first link 313 is rotated in the D direction with the first hinge protrusion 313*a* as the central axis.

When the first link 313 is rotated in the D direction, the second hinge protrusion 313*c* pulls the hinge hole 314*b* of the second link in the $X_1$ direction.

In addition, the coupling hole 314*a* of the second link 314 pulls the second shaft 104 in the $X_1$ direction.

Thereby, the torsion spring 121 is compressed and deformed, and the elastic force pressurizing the second shaft 104 to the feeding roller 101 is reduced.

The second shaft 104 is slide and linearly moved along the guide grooves 105*a* and 105*b* formed in the first and second guide members 105-1 and 105-2, and the pressure roller 102 moves away from the feeding roller 101 and the nip is released.

That is, the rotation motion of the door 20 and the first link 313 is converted into the linear motion of the second shaft 104 by the second link 314, and the nip between the pressure roller 102 and the feeding roller 104 is released according to the opening of the door 20.

However, in a case in which the second shaft 104 moves an excessively long distance in the $X_1$ direction, the torsion spring 121 may be permanently deformed.

In the case in which the torsion spring 121 is permanently deformed, even if the door 20 is closed, the second shaft 104 is not sufficiently pressurized to the feeding roller 101, and consequently, the nip may not be formed between the pressure roller 102 and the feeding roller 101.

Therefore, in order to prevent the permanent change of the torsion spring 121, it is preferable to limit the movement distance of the second shaft 104 within a range in which the paper jammed in the feeding part 100 may be easily removed.

According to the present exemplary embodiment, the first link 313 is configured to be rotated with the first hinge protrusion 313*a* as the central axis, and the second bending part 313*b* formed in the first link 313 is configured to be rotated only by a predetermined distance by the contact part 23 of the door. Thereby, the movement distance of the second shaft 104 is limited.

Also, in the present exemplary embodiment as well, an angle range (θ, θ') of a direction in which the pressure roller 102 is spaced apart from the feeding roller 101 is preferably formed within a range of ±15° from a normal to a tangent surface on which the feeding roller 101 and the pressure roller 102 form the nip.

In a case in which the nip is released according to the above-mentioned operations, since the pressure roller 102 no longer provides the friction force or the pressure to the paper jammed in the feeding part 100, the user may easily remove the paper jammed in the feeding part 100 from the feeding part 100.

In a case in which the user removes the paper jammed in the feeding part 100 and closes the door 20, when the door 20 rotates in a direction opposite to the R direction about a door shaft (not shown), the contact part 23 formed at one end 20*a* of the door 20 rotates in an outward direction of the main body.

When the contact part 23 rotates in the outward direction of the main body, the second bending part 313*b* formed at one end 311" of the first portion is spaced apart from the contact part 23.

Thereby, the external force pushing the second bending part 313*b* in the D direction is removed, and the force that the second hinge protrusion 313*c* pulls the hinge hole 314*b* of the second link is also removed.

In addition, the torsion spring 121 is returned to an original form by the elastic force and elastically supports the second shaft 104 in the $X_2$ direction.

The second shaft 104 is linearly moved in the $X_2$ direction along the guide grooves 105*a* and 105*b* formed in the first and second guide members 105-1 and 105-2, and the hinge hole 314*b* of the second link pulls the second hinge protrusion 313*c* in the $X_2$ direction.

In this case, the first link 313 rotates in a direction opposite to the D direction with the first hinge protrusion 313*a* as the central axis.

In addition, the torsion spring 121 pressurizes the second shaft 104 in the $X_2$ direction, thereby allowing the pressure roller 102 and the feeding roller 101 to form the nip.

Since the torsion spring 121 continuously pressurizes the second shaft 104 to the feeding roller 101, the pressure roller 102 and the feeding roller 101 maintain the nip until the door 20 is again opened.

The movable member 310 according still another exemplary embodiment of the present disclosure has a structure in which the rotation motion of the door 20 is converted into the linear motion of the second shaft 104 by the first and second links 313 and 314 and the nip is released.

Hereinabove, although the present disclosure has been described with reference to the exemplary embodiments thereof, those skilled in the art will appreciate that various modifications, additions and substitutions are possible, without departing from the scope and spirit of the disclosure as disclosed in the accompanying claims.

What is claimed is:

1. An image forming apparatus comprising:

a main body;

a door connected to the main body by a hinge;

a feeding part including a feeding roller to feed paper and a pressure roller to press against the feeding roller by application of an elastic force of an elastic member to form a nip together with the feeding roller; and a movable member, having a first end connected to the door by the hinge and a second end connected to a shaft, to reduce the elastic force applied to the pressure roller such that when the door is opened the pressure roller and the shaft are moved in a nip releasing direction away from the feeding roller.

2. The image forming apparatus as claimed in claim 1, wherein the movable member is a single link having the first end connected to the door by the hinge and the second end connected to the shaft, and the pressure roller is rotatably coupled to the shaft.

3. The image forming apparatus as claimed in claim 1, wherein the shaft is slidably movable by a guide member.

4. The image forming apparatus as claimed in claim 3, wherein the guide member guides the pressure roller in a direction perpendicular to the nip.

5. The image forming apparatus as claimed in claim 1, wherein a coupling hole into which the shaft is inserted is formed in one end of the movable member, and the coupling hole is not to press the shaft to the feeding roller in a state in which the door is closed.

6. The image forming apparatus as claimed in claim 1, wherein the movable member includes:

a first portion interfering with one portion of the door to be moved when the door is opened; and a second portion formed to be extended in the first portion and releasing the elastic force applied to the shaft by applying pressure one portion of the elastic member.

7. The image forming apparatus as claimed in claim 6, wherein the shaft is slidably movable by a guide member.

8. The image forming apparatus as claimed in claim 6, wherein the second portion is formed to be bent at a predetermined angle with respect to the first portion.

9. The image forming apparatus as claimed in claim 8, wherein the second portion has an inclined surface formed thereon so that one portion of the elastic member is in contact with the second portion and is slidably movable.

10. The image forming apparatus as claimed in claim 6, wherein the first portion has an interference protrusion formed to interfere with the main body and to limit a movement range of the movable member to a predetermined range.

11. The image forming apparatus as claimed in claim 1, wherein the movable member includes:

a first portion having a central portion connected to one portion of the main body by the hinge and a first end portion interfering with one portion of the door; and a second portion having a first end portion connected to a second end portion of the first portion by the hinge and a second end portion connected to the shaft.

12. The image forming apparatus as claimed in claim 11, wherein the first end portion of the second portion and the second end portion of the first portion which are connected by the hinge, are disposed at a position lower than a position of the shaft.

13. The image forming apparatus as claimed in claim 1, wherein the elastic member includes a torsion spring having a first end connected to the main body and a second end connected to the shaft.

14. The image forming apparatus as claimed in claim 1, further comprising:

a developing unit to form an image on the paper; and a fusing unit, disposed downstream of the developing unit with respect to a paper transport path along which the paper travels, to fuse the image on the paper, wherein the feeding roller is to transport the paper to the developing unit and is disposed upstream of the developing unit with respect to the paper transport path.

15. The image forming apparatus as claimed in claim 1, wherein when the door is opened the pressure roller is moved in the nip releasing direction away from the feeding roller and toward the hinge.

16. An image forming apparatus comprising:

a main body;

a door connected to the main body by a hinge;

a feeding part including a feeding roller to feed paper and a pressure roller to press against the feeding roller by application of an elastic force of an elastic member to form a nip together with the feeding roller; and a movable member to reduce the elastic force applied to the pressure roller so that the pressure roller is moved in a nip releasing direction away from the feeding roller according to an opening operation of the door, wherein an angle range of a direction in which the pressure roller is spaced apart from the feeding roller is ±15° on the basis of a normal direction to the nip.

17. An image forming apparatus comprising:

a rotatable door;

a pick-up module including a feeding roller to transfer paper from a cassette;

a friction module including a pressure roller to apply pressure to the pick-up module, disposed to form a nip with the pick-up module where the pressure is applied, and to provide a friction force to a surface of the paper passing through the nip; and a link to have a first end connected to the door and a second end connected to the friction module, and to convert a rotation motion of the door into a linear motion as the door is opened to release the pressure applied to the nip formed by the friction module and the pick-up module.

* * * * *